US008011779B2

(12) United States Patent
Matsuhashi

(10) Patent No.: US 8,011,779 B2
(45) Date of Patent: Sep. 6, 2011

(54) LIQUID EJECTING APPARATUS

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 21 days.

(21) Appl. No.: 12/478,127

(22) Filed: Jun. 4, 2009

(65) Prior Publication Data

US 2009/0303285 A1 Dec. 10, 2009

(30) Foreign Application Priority Data

Jun. 9, 2008 (JP) ..... 2008-150803

(51) Int. Cl.
*B41J 11/02* (2006.01)

(52) U.S. Cl. ..... 347/102

(58) Field of Classification Search ..... None
See application file for complete search history.

(56) References Cited

U.S. PATENT DOCUMENTS 6,730,357 B2 * 5/2004 Kawase ..... 427/258

FOREIGN PATENT DOCUMENTS

JP 2007-253613 10/2007

* cited by examiner

*Primary Examiner* — Matthew Luu
*Assistant Examiner* — Alejandro Valencia
(74) *Attorney, Agent, or Firm* — Maschoff Gilmore & Israelsen

(57) ABSTRACT

A liquid ejecting apparatus includes: a supporting member that supports a target; a liquid ejecting head that ejects liquid to a liquid ejecting surface of the target supported by the supporting member; an air blowing device that blows air to the liquid ejecting surface of the target supported by the supporting member; and a guide member that has an opposed surface which is closely opposed to the liquid ejecting surface of the target supported by the supporting member and forms a gap for passing the air, which is blown by the air blowing device as laminar flow along the liquid ejecting surface, between the opposed surface and the liquid ejecting surface.

9 Claims, 6 Drawing Sheets

LIQUID EJECTING APPARATUS

BACKGROUND

1. Technical Field

The present invention relates to a liquid ejecting apparatus such as an ink jet type printer.

2. Related Art

Generally, an ink jet type printer (hereinafter, it is referred to as a "printer") is well known as a liquid ejecting apparatus for ejecting liquid toward a target (for example, JP-A-2007-253613). The printer disclosed in JP-A-2007-253613 includes an air blowing device provided on a side of a head section on which an ink jet head (liquid ejecting head) for ejecting ink (liquid) toward a printing medium (target) is mounted. The air blowing device is attached to the rear side of the head section relative to a traveling direction of the head section at the time of printing. The air blowing device is provided with guide walls including curved surfaces for bending the air jetted from the air nozzle at right angle and parallel surfaces for generating airflow horizontal to the printing plane. By adopting such a configuration, the air blowing device is adapted to generate the horizontal airflow flowing in a direction of increasing a distance from the head section adjacent thereto. In addition, the head section ejects ink toward the target from the ink jet head while performing a reciprocating motion. The air blowing device dries the ink ejected on the target by generating the horizontal airflow.

When the ink on the target is dried, a solvent of the ink evaporates, and thus a vapor pressure on the target surface as the evaporation front is approximated to a saturated vapor pressure. A vapor pressure gradient from the saturated vapor pressure to a vapor pressure of outside ambient air which is not saturated is formed in a still air layer (diffusion layer) in which air neighboring the evaporation front is still. In JP-A-2007-253613, the thickness of the diffusion layer is reduced by blowing air to the evaporation front of the target surface, and thus the vapor pressure gradient is increased to thereby accelerate evaporation of the ink solvent.

However, in the printer disclosed in JP-A-2007-253613, the horizontal airflow generated by the air blowing device is gradually diffused as it moves farther from the guide walls. For this reason, the time period of exposing the diffusion layer of the target surface to the horizontal airflow having an air speed required to reduce the thickness of the diffusion layer is shortened. This causes a problem in that it is hard to obtain a sufficient evaporation accelerating effect. Furthermore, substantially the same problem arises in not only the ink jet type printers but also in liquid ejecting apparatuses for accelerating drying of the target by blowing air.

SUMMARY

An advantage of some aspects of the invention is that it provides a liquid ejecting apparatus capable of efficiently accelerating drying of liquid which is ejected from a liquid ejecting head and adhered to a liquid ejecting surface of a target.

According to an aspect of the invention, a liquid ejecting apparatus includes: a supporting member that supports a target; a liquid ejecting head that ejects liquid to a liquid ejecting surface of the target supported by the supporting member; an air blowing device that blows air to the liquid ejecting surface of the target supported by the supporting member; and a guide member that has an opposed surface which is closely opposed to the liquid ejecting surface of the target supported by the supporting member and forms a gap for passing the air, which is blown by the air blowing device as laminar flow along the liquid ejecting surface, between the opposed surface and the liquid ejecting surface.

In accordance with the above-mentioned configuration, the air blown from the air blowing device toward the liquid ejecting surface flows as laminar flow along the liquid ejecting surface through the gap formed between the liquid ejecting surface and the opposed surface of the guide member since the guide members have the opposed surface closely opposed to the liquid ejecting surface of the target supported by the supporting member. That is, it is possible to efficiently flow the air at a constant air speed required to reduce the thickness of the diffusion layer since the guide member suppresses diffusion of the air blown from the air blowing device. By adopting such a configuration, it is possible to sufficiently secure time required for the air to reach the liquid ejecting surface of the target, and thus it is possible to efficiently accelerate drying of the liquid which is ejected from the liquid ejecting head and is adhered on the liquid ejecting surface of the target.

In the liquid ejecting apparatus according to the aspect of the invention, it is preferable that the guide member be formed by a film member stretched to cover the liquid ejecting surface of the target.

In accordance with the above-mentioned configuration, it is possible to achieve a space saving configuration with light weight even when the guide member covers over a large area since the guide member is formed by a film member stretched to cover the liquid ejecting surface of the target.

In the liquid ejecting apparatus according to the aspect of the invention, it is preferable that the liquid ejecting head be configured to be movable along the liquid ejecting surface of the target, relative to the supporting member. It is also preferable that the liquid ejecting apparatus further include a displacement mechanism that displaces the film member so as to avoid interference with the liquid ejecting head when the liquid ejecting head moves relative to the supporting member.

In accordance with the above-mentioned configuration, it is avoided that the liquid ejecting head interferes with the film member since the film member are displaced by the displacement mechanism even when the liquid ejecting head moves along the liquid ejecting surface of the target so as to eject the liquid. Accordingly, it is possible to stretch the film member in the entire liquid ejecting area including the moving range of the liquid ejecting head. By adopting such a configuration, it is possible to dry the liquid which is adhered on the liquid ejecting surface of the target on the supporting member even without an individual area for drying the target. It is also possible to dispose the film member at an optimum position while keeping the liquid ejecting head at a position suitable for liquid ejection by employing the displacement mechanism, although it is preferable that the gap formed between the opposed surface of the film member and the liquid ejecting surface of the target be set larger than the diffusion layer under non-airflow condition and be set as narrow as the air does not diffuse.

In the liquid ejecting apparatus according to the aspect of the invention, it is preferable that the displacement mechanism have rotary members which rotate in accordance with movement of the liquid ejecting head relative to the supporting member, and it is also preferable that the film member be displaced in a direction of avoiding interference with the liquid ejecting head by rotational force of the rotary members.

In accordance with the above-mentioned configuration, it is possible to smoothly displace the film member while suppressing load applied at the time of displacement since the film member are displaced by rotational force of the rotary member which rotates in accordance with the movement of the liquid ejecting head relative to the supporting member.

In the liquid ejecting apparatus according to the aspect of the invention, it is preferable that one end of the film member be fixedly attached to the liquid ejecting head or a movable body which is movable with the liquid ejecting head mounted thereon, and the other end thereof be wound around the rotary member. It is also preferable that the rotary member be rotationally urged in a direction of winding the film member.

In accordance with the above-mentioned configuration, it is possible to efficiently flow air without air leakage caused by a joint between the liquid ejecting head or the movable body and the film member since the one end of the film member is fixedly attached to the liquid ejecting head or the movable body which is movable with the liquid ejecting head mounted thereon. Furthermore, the other end thereof is wound around the rotary member, and the rotary member is rotationally urged in a direction of winding the film member. Accordingly, it is possible to adopt a configuration in which the wound film member is drawn out from the rotary member when the liquid ejecting head moves in a direction of increasing a distance from the rotary member, and the film member is wound around the rotary member by elastic force when the liquid ejecting head moves in a direction of decreasing the distance from the rotary member. In this case, it is possible to achieve a space saving configuration in the displacement mechanism since it is not necessary to secure a large area for the area for displacing the film member.

In the liquid ejecting apparatus according to the aspect of the invention, it is preferable that at least the one end of the film member be supported by an elastic member. It is also preferable that the rotary members be supported at height positions where the film member is stretched, and at positions which are farther than the height position from the supporting member, respectively, relative to the movable body which is movable with the liquid ejecting head mounted thereon. It is also preferable that the film member be suspended on the rotary members so as to avoid interference with the liquid ejecting head.

In accordance with the above-mentioned configuration, it is possible to absorb vibrations caused by air-blowing and displacement operations and the like through elastic deformation of the elastic member since the at least the one end of the film member is supported by the elastic member. Furthermore, the film member is suspended so as to avoid interference with the liquid ejecting head while the rotary members are supported at height positions where the film member is stretched, and at positions which are farther than the height position from the supporting member, respectively relative to the movable body which is movable with the liquid ejecting head mounted thereon. Accordingly, it is possible to partially change the extending direction of the film member since the film member is suspended on the rotary members which are supported at height positions different from each other relative to the supporting member. As a result, it is possible to avoid interference between the film member and the liquid ejecting head since the height of the stretched film member is partially changed by the rotary members.

In the liquid ejecting apparatus according to the aspect of the invention, it is preferable that at least a part of the guide member covering the liquid ejecting surface of the target be transparent.

In accordance with the above-mentioned configuration, it is possible to easily view a state of the liquid ejecting surface of the target such as a state of the printing performed by ejecting liquid even when the target is covered with the guide member since a part of the guide member covering over the liquid ejecting surface of the target is transparent.

It is preferable that the liquid ejecting apparatus according to the aspect of the invention further include a windshield member that shields a nozzle formation surface of the liquid ejecting head from the air blown by the air blowing device.

In accordance with the above-mentioned configuration, it is possible to suppress influence such as drying caused by the airflow in the nozzles since the windshield member is able to shield the nozzle formation surface from the air which is blown by the air blowing device.

It is preferable that the liquid ejecting apparatus according to the aspect of the invention further include a suctioning device that suctions the air passed through a gap between the opposed surface of the guide member and the liquid ejecting surface of the target, the suctioning device provided on a downstream side in an air-blowing direction of the air blowing device.

In accordance with the above-mentioned configuration, it is possible to more efficiently blow air onto the liquid ejecting surface of the target by allowing the air blowing device to blow air and additionally allowing the suctioning device to suction the air on the downstream side of the air-blowing direction. Further, it is possible to suppress unnecessary rise in temperature since the suctioning device suctions the heated air even when the air blowing device blows hot air having a temperature higher than ambient temperature or the supporting member transfers heat to the target in order to accelerate drying of the liquid. Moreover, it is possible to collect evaporated solvents of the liquid, remaining mist generated by liquid ejection, dust of the surface of the target, and the like, without diffusing those, by allowing the suctioning device to suction the air passing the gap. As a result, it is possible to suppress contamination in the target and the liquid ejecting apparatus.

In the liquid ejecting apparatus according to the aspect of the invention, it is preferable that the air blowing device be configured to blow air in a direction parallel to an extending direction of a nozzle array formed on a nozzle formation surface of the liquid ejecting head.

In accordance with the above-mentioned configuration, it is possible to suppress airflow influence at the time of ink ejection since the air blowing device is configured to blow air in a direction parallel to the extending direction of the nozzle array formed on the nozzle formation surface of the liquid ejecting head.

BRIEF DESCRIPTION OF THE DRAWINGS

The invention will be described with reference to the accompanying drawings, wherein like members reference like elements.

DESCRIPTION OF EXEMPLARY EMBODIMENTS

First Embodiment

First of all, a lateral ink jet type printer using a liquid ejecting apparatus according to a first embodiment of the invention will be described with reference to FIGS. 1 to 4. In the following description, "front-rear direction", "left-right direction", and "up-down direction" are indicated by arrows shown in FIGS. 1 to 8.

Figure 1:
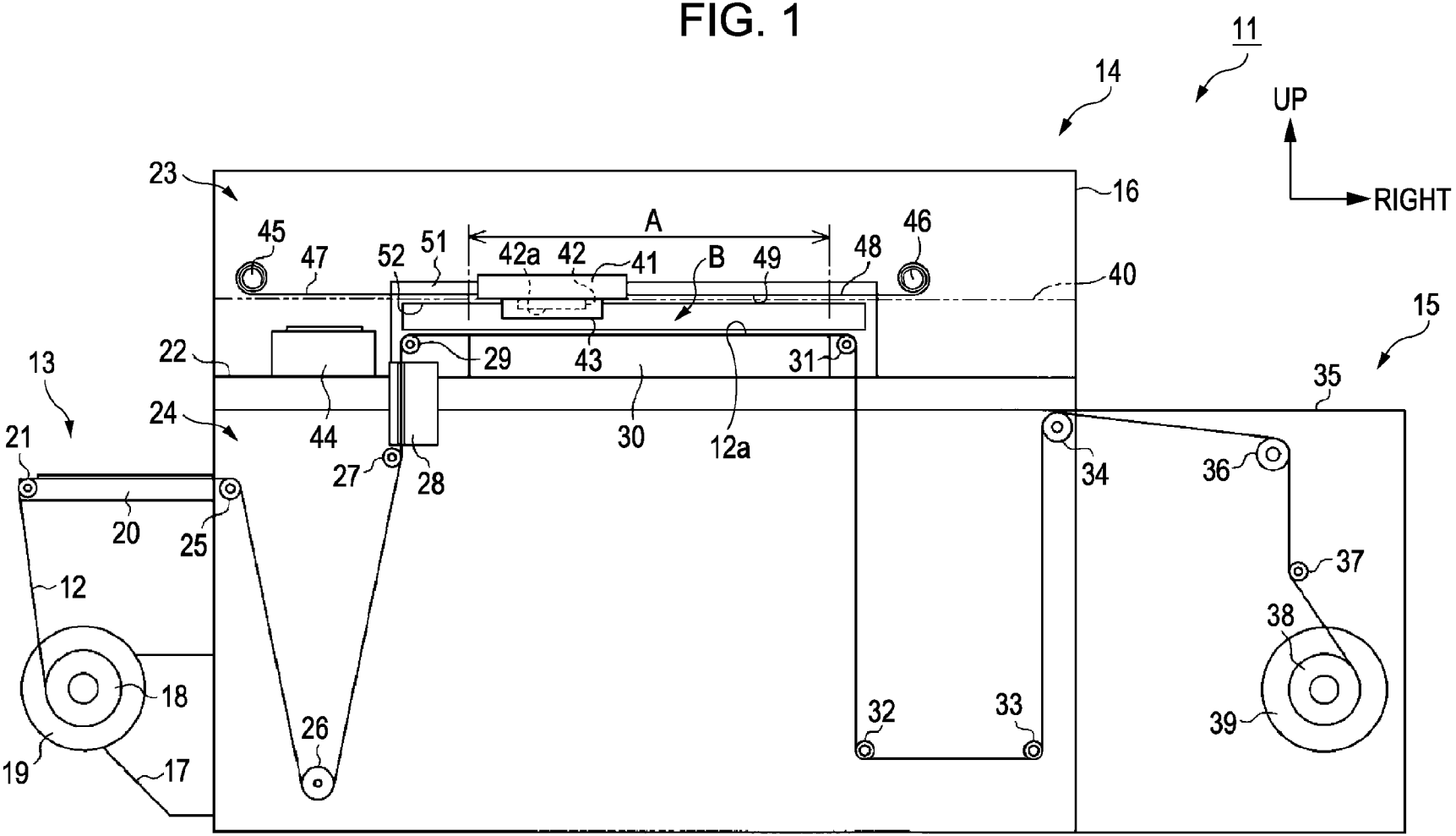
FIG. 1 is a schematic front view illustrating an ink jet type printer according to a first embodiment of the invention.

As shown in FIG. 1, an ink jet type printer 11 as a liquid ejecting apparatus includes a drawing-out section 13 for drawing out a continuous form paper 12 as an elongated target, a body section 14 for sequentially performing printing and drying operations on the continuous form paper 12 drawn out from the drawing-out section 13, and a winding section 15 for winding the continuous form paper 12 printed and dried by the body section 14. Specifically, the body section 14 has a body casing 16 having a rectangular parallelepiped shape, the drawing-out section 13 is disposed on the left side of the body casing 16, that is, the upstream side of a transport direction of the continuous form paper 12, and the winding section 15 is disposed on the right side of the body casing 16, that is, the downstream side thereof.

First, a transport mechanism for the continuous form paper 12 will be described with reference to FIG. 1.

The drawing-out section 13 has a supporting plate 17 extending leftward from the lower end portion of the exterior surface on the left side of the body casing 16. The supporting plate 17 is provided with a winding shaft 18 which is rotatable and extends toward the front-rear direction (a direction perpendicular to the paper surface in FIG. 1). The base end of the winding shaft 18 is provided with a discoid rotation plate 19 for rotating integrally with the winding shaft 18. The continuous form paper 12, which is previously wound in a roll shape, is supported by the winding shaft 18 so as to be able to rotate integrally with the winding shaft 18. In the embodiment, a glossy paper is used as the continuous form paper 12.

The central portion of the exterior surface on the left side of the body casing 16 is provided with a drawing-out tray 20 which has a planar shape and extends horizontally toward the left side. The front end portion of the drawing-out tray 20 is provided with a relay roller 21, which is rotatable, for suspending the continuous form paper 12, which is drawn out from the winding shaft 18, and guiding it to the upper surface of the drawing-out tray 20.

The body casing 16 of the body section 14 is provided with a plate-like table 22 which is positioned near and slightly above the central portion thereof in the up-down direction so as to partition the inside of the body casing 16 into upper and lower areas. The upper area of the table 22 in the body casing 16 is formed as a printing chamber 23 for printing on the continuous form paper 12. On the other hand, the lower area of the table 22 in the body casing 16 is formed as a transporting chamber 24 for transporting the continuous form paper 12.

The left side wall of the body casing 16 is provided with a feed opening, which is not shown, for feeding the continuous form paper 12 in the transporting chamber 24 from the upper surface of the drawing-out tray 20. The left end portion of the transporting chamber 24 is provided with a drawing driving roller 25 which is rotatable and is opposed to the feed opening at a close distance to each other.

An elevator roller 26, which is rotatable and is movable to be elevated by driving an elevating mechanism not shown, and a relay roller 27 which is rotatable are provided on the right side of the drawing driving roller 25 in the transporting chamber 24. The continuous form paper 12 which is fed into the transporting chamber 24 by driving the drawing driving roller 25 is suspended on the lower portion of the elevator roller 26, and is suspended on the right portion of the relay roller 27.

The table 22 is provided with a guide device 28 which is formed at a position opposed to the relay roller 27 so as to penetrate the table 22 in the up-down direction. The guide device 28 is configured to guide the continuous form paper 12 in the transport direction (here, the upward direction). A relay roller 29 is provided above the guide device 28 in the printing chamber 23. The continuous form paper 12 passing through the guide device 28 is suspended on the lower left portion of the relay roller 29 so as to be transported horizontally in the right direction.

The area on the right side of the relay roller 29 in the printing chamber 23 is provided with a platen 30 as a supporting member having a rectangular planar shape supported on the table 22. The platen 30 is configured to be heated by a heater which is not shown. Thus, heat is transferred to the continuous form paper 12 on the heated platen 30, thereby accelerating drying of ink adhered on the continuous form paper 12.

A turning roller 31 which is opposed to the relay roller 29 is provided on the right side of the platen 30 with the platen 30 interposed therebetween. Here, the top of the relay roller 29, the upper surface of the platen 30, and the top of the turning roller 31 are coplanar.

The turning roller 31 turns the transport direction of the continuous form paper 12 from the horizontal right direction into the vertical downward direction since the continuous form paper 12, which is transported horizontally in the right direction along the upper surface of the platen 30 from the relay roller 29, is suspended on the upper left portion of the turning roller 31. The continuous form paper 12 of which the transport direction is turned into the vertical downward direction by the turning roller 31 is transported into the transporting chamber 24 again through an insertion opening, which is not shown, provided on the table 22.

The inside of the transporting chamber 24 is provided with a reversing roller 32 positioned below the turning roller 31. The continuous form paper 12 transported into the transporting chamber 24 is suspended on the upper left portion of the reversing roller 32 so as to be transported in the horizontal right direction.

Moreover, the continuous form paper 12 is suspended on the lower left portion of the relay roller 33 which is rotatably provided on the right side of the relay roller 32, and is suspended on the lower left portion of a discharge driving roller 34 which is provided above the relay roller 33. A discharge opening, which is not shown, for discharging the continuous form paper 12 toward the winding section 15 is provided at a position corresponding to the upper end portion of the transporting chamber 24 on the right side wall of the body casing 16. By driving the discharge driving roller 34, the continuous form paper 12 is delivered to the winding section 15 through the discharge opening.

The winding section 15 includes a winding frame 35 having a rectangular parallelepiped shape. The upper end portion of the winding frame 35 is provided with a relay roller 36 which is rotatable. The continuous form paper 12 delivered from the discharge opening is suspended on the upper left portion of the relay roller 36 so as to be transported in the downward direction.

A relay roller 37 and a winding drive shaft 38 are rotatably provided below the relay roller 36 in the winding frame 35. The continuous form paper 12 is suspended on the left portion of the relay roller 37 so as to be transported diagonally downward right, and is wound around the winding drive shaft 38 by rotating the winding drive shaft 38. The base end of the winding drive shaft 38 is provided with a discoid rotation plate 39 for rotating integrally with the winding drive shaft 38. The rotation plate 39 functions as a guide for determining a position at which the continuous form paper 12 is wound around the winding drive shaft 38.

Next, a printing mechanism for the continuous form paper 12 will be described with reference to FIGS. 1 to 4.

Paired guide rails 40 (indicated by a chain double-dashed line in FIG. 1) extending in the left-right direction are provided on either side of the front and rear of the platen 30 in the printing chamber 23. The upper surfaces of the guide rails 40 are set higher than the upper surface of the platen 30. The upper surfaces of both guide rails 40 supports a carriage 41 as a rectangular planar movable body capable of reciprocating in the left-right direction along the guide rails 40. The carriage 41 is configured to move in the left-right direction on the guide rails 40 by driving a driving mechanism which is not shown.

The lower surface of the carriage 41 supports a printing head 42 as a liquid ejecting head. Specifically, the printing head 42 is configured to be able to move relative to the platen 30 along a printing surface 12*a* as a liquid ejecting surface of the continuous form paper 12. The lower surface of the carriage 41 supports a windshield member 43 having, in plan view, a U-shape which surrounds the front side and the left and right sides of the printing head 42 and opens toward the rear side thereof. The lower surface of the windshield member 43 is positioned lower than the nozzle formation surface 42*a* which is formed by the lower surface of the printing head 42.

Figure 2:
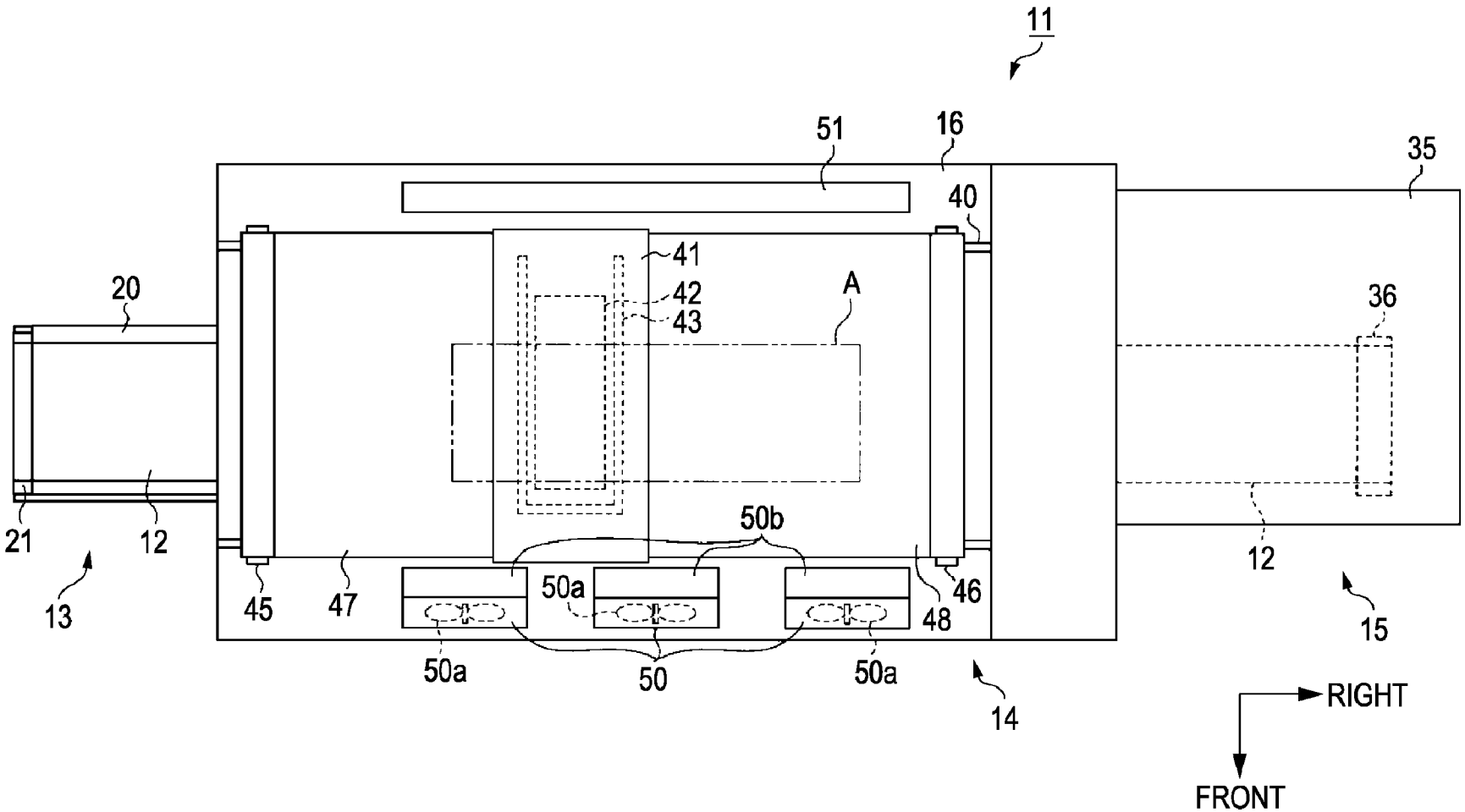
FIG. 2 is a schematic top plan view illustrating the ink jet type printer according to the first embodiment.
Figure 3:
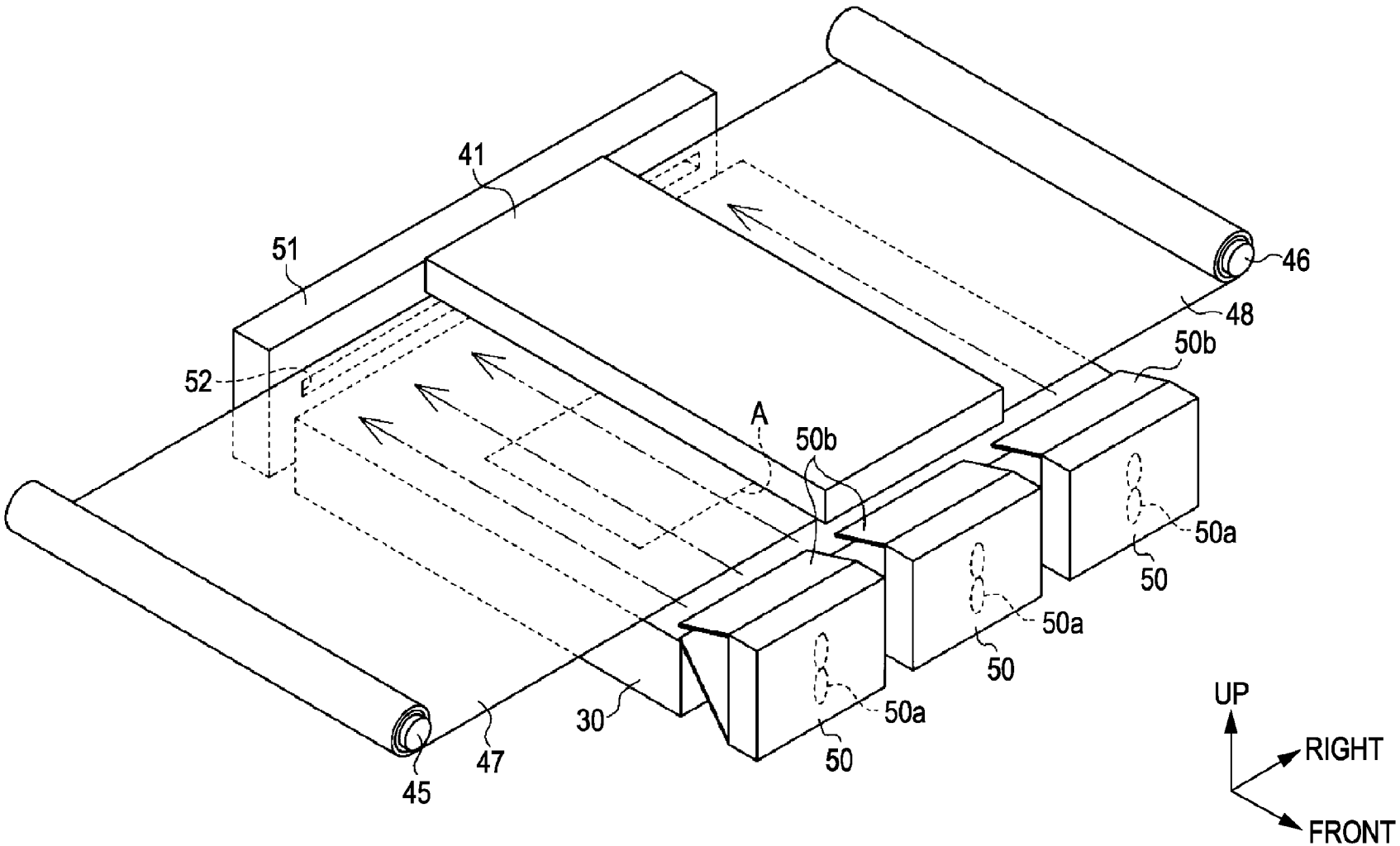
FIG. 3 is a schematic perspective view illustrating a drying mechanism of the ink jet type printer according to the first embodiment.

As shown in FIGS. 1 to 3, a printing area A which is a liquid ejecting area is defined as an area in which the printing of the continuous form paper 12 is performed in the range from the left end to the right end of the platen 30, and the area is located in the course of the transporting path of the continuous form paper 12. Thus, the continuous form paper 12 is intermittently transported by the unit of the printing area A. Specifically, when the printing, which is performed while the carriage 41 moves from the left end of the printing area A to the right end thereof, is complete, the continuous form paper 12 is transported until the left end of the printed area is shifted to the right end of the printing area A, and then the paper is stopped. By alternately performing the printing operation on the unit printing area A and the transporting operation on the continuous form paper 12, printing operations are successively performed on the continuous form paper 12.

The body casing 16 is provided with a plurality of detachable ink cartridges (not shown) containing respective inks having different colors from each other. The ink cartridges (not shown) are connected to the printing head 42 through ink supply tubes (not shown). The body casing 16 is provided with a pressure pump (not shown) for pressurizing the inside of the ink cartridges (not shown). By driving the pressure pump, the inks in the ink cartridges (not shown) are supplied to the printing head 42 through the ink supply tubes (not shown).

Figure 4A:
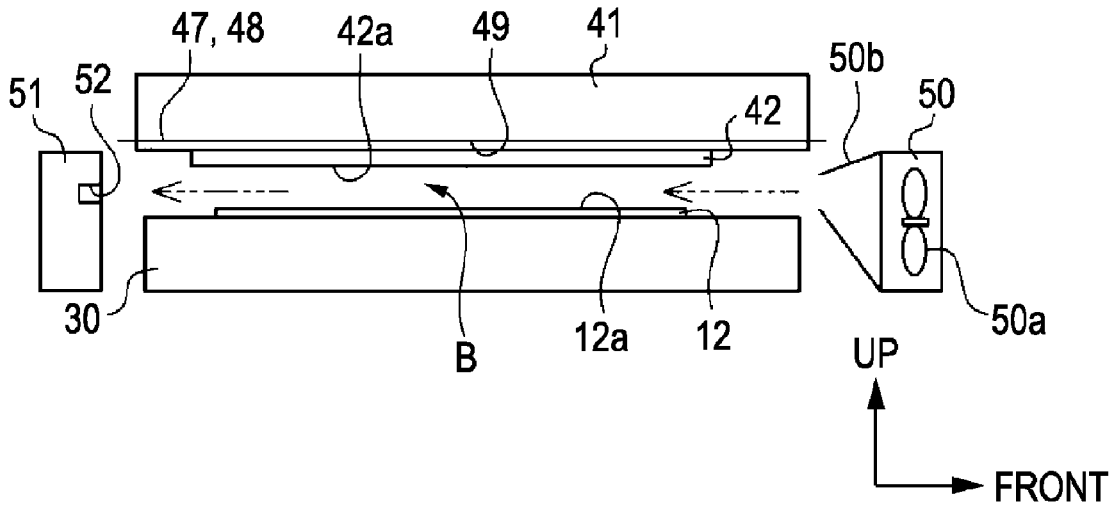
FIG. 4A is a schematic left side view illustrating the drying mechanism of the ink jet type printer according to the first embodiment.
Figure 4B:
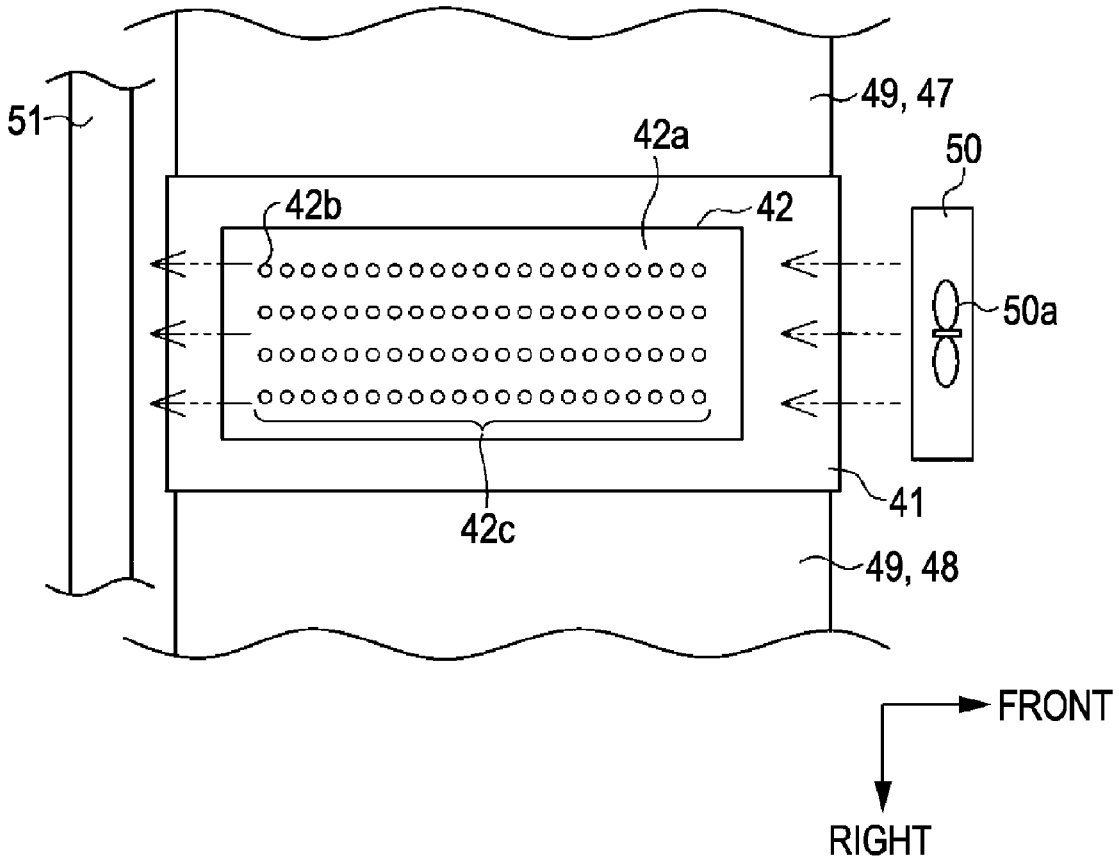
FIG. 4B is a schematic bottom view illustrating the drying mechanism of the ink jet type printer according to the first embodiment.

The nozzle formation surface 42*a* which is formed by the lower surface of the printing head 42 is provided with a plurality of nozzle openings 42*b* (refer to FIG. 4B) as shown in FIG. 4. The inks, which are supplied from the ink cartridges toward the printing surface 12*a* of the continuous form paper 12 transported to and stopped on the platen 30, are ejected from the nozzle openings 42*b*, thereby performing a printing operation. In the embodiment, the nozzle openings 42*b* are formed at a constant distance away from each other in the left-right direction so as to form a plurality (four arrays in FIG. 4B) of nozzle arrays 42*c* (refer to FIG. 4B), which extends in the front-rear direction, on the nozzle formation surface 42*a*.

A maintenance unit 44 for performing maintenance of the printing head 42 such as a cleaning, which is performed by a suctioning of the nozzle openings 42*b*, is provided on the left side of the platen 30 on the table 22 as shown in FIG. 1.

Next, a drying mechanism for the printed continuous form paper 12 will be described with reference to FIGS. 1 to 4.

Paired rotary shafts 45 and 46 which constitute a displacement mechanism are provided on either side of the left and right of the printing area A in the printing chamber 23. The rotary shafts 45 and 46 are configured to extend in the front-rear direction and be rotatably supported by a supporting wall which is not shown. The rotary shaft 45 is provided on a left end portion corresponding to the left side of the maintenance unit 44 in the printing chamber 23. The rotary shaft 46 is provided near a right end portion corresponding to the right side of the turning roller 31.

A film member 47 as a guide member is stretched above the guide rail 40. The left end portion of the film member 47 is wound around the rotary shaft 45, and the right end portion thereof is fixedly attached to the lower end portion of the left side surface of the carriage 41. The right end portion of the film member 48 as a guide member pairing with the film member 47 is wound around the rotary shaft 46, and the left end portion of the film member 48 is fixedly attached to the lower end portion of the right side of the carriage 41.

The rotary shafts 45 and 46 are rotationally urged by respective urging members, which are not shown, in a direction of rewinding the film members 47 and 48. Thus, the film members 47 and 48 are stretched above the platen 30 so as to cover the printing surface 12*a* of the continuous form paper 12 supported on the platen 30. Furthermore, the film members 47 and 48 are made of transparent plastic films so as to visibly check the printing surface 12*a* of the continuous form paper 12 on which the printing is performed.

Each of the rotary shafts 45 and 46 rotates by driving the driving mechanism, which is not shown, while the carriage 41 moves in the left-right direction along both guide rails 40, thereby keeping a stretching state of the film members 47 and 48. When the carriage 41 moves in the left direction, the rotary shafts 45 and 46 rotate in a clockwise direction in FIG. 1, thereby winding the left end portion of the film member 47 around the rotary shaft 45 and drawing out the film member 48 of which the right end portion is wound around the rotary shaft 46. By contrast, when the carriage 41 moves in the right direction, the rotary shafts 45 and 46 rotate in a counterclockwise direction in FIG. 1, thereby drawing out the left end portion of the film member 47 wound around the rotary shaft 45 and winding the right end portion of the film member 48 around the rotary shaft 46.

The unwound portions of the film members 47 and 48 from the rotary shafts 45 and 46 are stretched at a constant height from the upper surface of the platen 30, and widths of those are substantially the same as that of the carriage 41. The opposed surfaces 49 (refer to FIG. 1) formed by the lower surfaces of the film members 47 and 48 unwound from the rotary shafts 45 and 46 are held at a position opposed to the upper surface of the platen 30 so as to face the printing surface 12*a* of the continuous form paper 12 supported on the platen 30 at a close distance.

An air blowing device 50 is disposed on the front side of the platen 30 on the table 22. The inside of the air blowing device 50 is provided with a fan 50*a* which rotates to blow air by driving the driving mechanism not shown as shown in FIGS. 2 to 4. Although not shown in the drawing, a heater is provided near the downstream side in an air-blowing direction of the fan 50*a* inside the air blowing device 50. The rear side surface of the air blowing device 50 is provided with a blade plate 50*b* for blowing hot air into a gap B (refer to FIG. 4A) formed between the printing surface 12*a* of the continuous form paper 12 and the opposed surfaces 49 of the film members 47 and 48. Specifically, the air blowing device 50 is configured to blow hot air, which is guided by the blade plate 50*b* and flows rearward along the opposed surface 49 of the film members 47 and 48, toward the printing surface 12*a* of the continuous form paper 12 on the platen 30, by rotating the fan 50*a* in a state where the heater is driven. In FIG. 1, the air blowing device 50 is not shown.

Meanwhile, a suctioning device 51 is disposed at a position opposed to the air blowing device 50 in the front-rear direction, on the rear side of the platen 30 on the table 22. The suctioning device 51 is configured to suction the hot air which is blown from the front side of the platen 30 toward the rear side thereof and passes through the gap B by the air blowing device 50. Specifically, the intake 52 of the suctioning device 51 is disposed on a position suitable for suctioning air in the space formed in the gap B between the upper surface of the platen 30 and the opposed surfaces 49 of the film members 47 and 48, in the up-down direction and the left-right direction, as shown in FIGS. 1 and 3.

Next, operations of the ink jet type printer 11 configured as described above will be described.

When the printing is not performed, the carriage 41 is positioned on the maintenance unit 44, the most part of the film member 47 is wound around the rotary shaft 45, and the most part of the film member 48 is drawn out from the rotary shaft 46. Specifically, the opposed surface 49 formed by the lower surface of the film member 48 covers over the upper surface of the platen 30 in the printing area A.

When the printing is performed, the platen 30 is heated, and the carriage 41 positioned on the maintenance unit 44 is moved in the right direction in FIG. 1, and is placed on an initial position of the printing operation, on the left end side of the printing area A. In this case, the film member 47 wound around the rotary shaft 45 is drawn out, and the right end portion of the film member 48 is wound around the rotary shaft 46.

Subsequently, when the continuous form paper 12 is transported and stopped on the platen 30, ink is ejected on the printing surface 12*a* from the printing head 42 while the carriage 41 moves in the left-right direction, thereby performing a printing operation in the printing area A. Simultaneously, the air blowing device 50 blows hot air, and the suctioning device 51 suctions the air, thereby blowing air into the gap B. In this case, since the film members 47 and 48 are stretched between the air blowing device 50 and the suctioning device 51, the blown air (indicated by the arrow of the chain double-dashed line in FIGS. 3 and 4) flows as laminar flow along the printing surface 12*a* thorough the gap B.

When the ink is ejected on the printing surface 12*a* of the continuous form paper 12, a vapor pressure of the upper surface of the printing surface 12*a*, on which the ink is adhered, approximately reaches the saturated vapor pressure since solvent of the ink evaporates. A vapor pressure gradient from the saturated vapor pressure to a vapor pressure of outside ambient air which is not saturated is formed in a still air layer (diffusion layer) in which air neighboring the printing surface 12*a* is still.

Here, while the air blown from the air blowing device 50 flows through the gap B, the airflow is kept at a strong air speed which is able to make the thickness of the diffusion layer less than that of the diffusion layer under non-airflow condition. Hence, the vapor pressure gradient of the diffusion layer becomes larger than that of the diffusion layer under non-airflow condition. Specifically, by suppressing upward diffusion of the airflow, which is guided by the film members 47 and 48 so as to flow in the horizontal direction, the air widely spreads over the entire printing surface 12*a* without large reduction in air speed. As a result, drying of the ink, which is adhered on the printing surface 12*a* of the continuous form paper 12, is efficiently accelerated.

Furthermore, while the printing is performed by moving the carriage 41 in the left-right direction, the rotary shafts 45 and 46 rotate in accordance with the movement of the carriage 41, and then the film members 47 and 48 are displaced in a direction of avoiding interference with the printing head 42 by rotational force of the rotary shafts 45 and 46.

Three sides, which includes the upstream side in the airflow direction, of the nozzle formation surface 42*a* of the printing head 42 are surrounded by the windshield member 43 on the lower side of the carriage 41, thereby preventing the nozzle formation surface 42*a* from being directly exposed to the airflow. The nozzle arrays 42*c* are formed along the front-rear direction on the nozzle formation surface 42*a*, and thus the extending direction of each nozzle array 42*c* substantially coincides with the airflow direction. Therefore, the nozzle arrays 42*c* are hardly affected by the airflow when the ink is ejected.

Moreover, the platen 30 is configured to be heated by the heater which is not shown, and the air blowing device 50 is configured to blow hot air, thereby further accelerating drying of the ink. Specifically, evaporation of solvent in the diffusion layer is accelerated by heating and hot air blowing operations, and the vapor pressure gradient increases by blowing air, thereby further effectively accelerating drying of the ink. Here, heat and hot air generated by the heater are collected by the suctioning device 51, thereby suppressing rise in temperature inside the printing chamber 23.

According to the first embodiment mentioned above, the following advantages can be obtained.

1. The air blown from the air blowing device 50 flows as laminar flow along the printing surface 12*a* through the gap B since the film members 47 and 48 have the opposed surfaces 49 closely opposed to the printing surface 12*a* of the continuous form paper 12. That is, it is possible to efficiently flow the air at a constant air speed required to reduce the thickness of the diffusion layer since the film members 47 and 48 suppresses diffusion of the air blown from the air blowing device 50. By adopting such a configuration, it is possible to sufficiently secure time required for the air to reach the printing surface 12*a* of the continuous form paper 12, and thus it is possible to efficiently accelerate drying of the ink which is ejected from the printing head 42 and is adhered on the printing surface 12*a* of the continuous form paper 12.

2. It is avoided that the printing head 42 interferes with the film members 47 and 48 since the film members 47 and 48 are displaced by the rotation of the rotary shafts 45 and 46 even when the printing head 42 moves in the left-right direction so as to eject the ink. Accordingly, it is possible to stretch the film members 47 and 48 in the entire printing area A including the moving range of the printing head 42. By adopting such a configuration, it is possible to dry the ink which is adhered on the printing surface 12*a* of the continuous form paper 12 on the platen 30 even without an individual area for drying the continuous form paper 12.

3. It is possible to dispose the film members 47 and 48 at an optimum height position for turning the air, which is blown from the air blowing device 50, into laminar flow while keeping the printing head 42 at a height position suitable for ink ejection by employing the rotary shafts 45 and 46, although it is preferable that the gap B be set larger than the diffusion layer under non-airflow condition and be set as narrow as the air does not diffuse.

4. It is possible to smoothly displace the film members 47 and 48 while suppressing load applied at the time of displacement since the film members 47 and 48 are displaced by rotational force of the rotary shafts 45 and 46 which rotate in accordance with the movement of the left-right direction of the printing head 42.

5. It is possible to efficiently flow air without air leakage caused by a joint between the carriage 41 and the film members 47 and 48 since the right end portion of the film member 47 and the left end portion of the film member 48 are fixedly attached to the carriage 41 equipped with the printing head 42.

6. It is not necessary to secure a large space for the area for displacing the film members 47 and 48 since the film members 47 and 48 are wound compactly by allowing the rotary shafts 45 and 46 to rotationally urge the respective film members 47 and 48 in the winding direction. As a result, it is possible to save a space for the displacement mechanism.

7. It is possible to easily view a state of the printing surface 12*a* of the continuous form paper 12 such as a printing result even when the continuous form paper 12 is covered with the film members 47 and 48 since a part of the film members 47 and 48 covering over the printing surface 12*a* of the continuous form paper 12 is transparent.

8. It is possible to suppress influence such as drying caused by the airflow in the nozzle openings 42*b* since the windshield member 43 shields the nozzle formation surface 42*a* from the air which is blown by the air blowing device 50.

9. It is possible to more efficiently perform air blowing by allowing the air blowing device 50 to blow air and additionally allowing the suctioning device 51 to suction the air on the downstream side of the air-blowing direction. Further, it is possible to suppress unnecessary rise in temperature of the inside of the printing chamber 23 since the suctioning device 51 suctions the heated air even when the air blowing device 50 blows hot air having a temperature higher than ambient temperature or the platen 30 transfers heat to the continuous form paper 12 in order to accelerate drying of the ink.

10. It is possible to collect evaporated solvents of the ink, remaining mist generated by ink ejection, dust of the surface of the continuous form paper 12, and the like, without diffusing those, by allowing the suctioning device 51 to suction the air passing the gap B. As a result, it is possible to suppress contamination in the continuous form paper 12 and the printer 11.

11. It is possible to suppress airflow influence at the time of ink ejection since the air blowing device 50 is configured to blow air in a direction parallel to the extending direction of the nozzle arrays 42*c* which are formed on the nozzle formation surface 42*a* of the printing head 42.

12. It is possible to dispose the air blowing device 50 without changing dispositions of the transporting devices even when the transporting devices of the continuous form paper 12 are disposed upstream and downstream in the transport direction of the continuous form paper 12 with the platen 30 interposed therebetween since the air blowing device 50 and the suctioning device 51 are disposed in the front-rear direction with the platen 30 interposed therebetween.

13. It is possible to blow air in a widthwise direction of the elongated continuous form paper 12 since the air blowing device 50 and the suctioning device 51 are disposed in the front-rear direction with the platen 30 interposed therebetween. Consequently, it is possible to efficiently accelerate drying of the ink ejected toward the continuous form paper 12 by suppressing air diffusion since an air-blowing distance is not increased.

Second Embodiment

Next, a serial ink jet type printer using a liquid ejecting apparatus according to a second embodiment of the invention will be described with reference to FIGS. 5 to 6.

Figure 5:
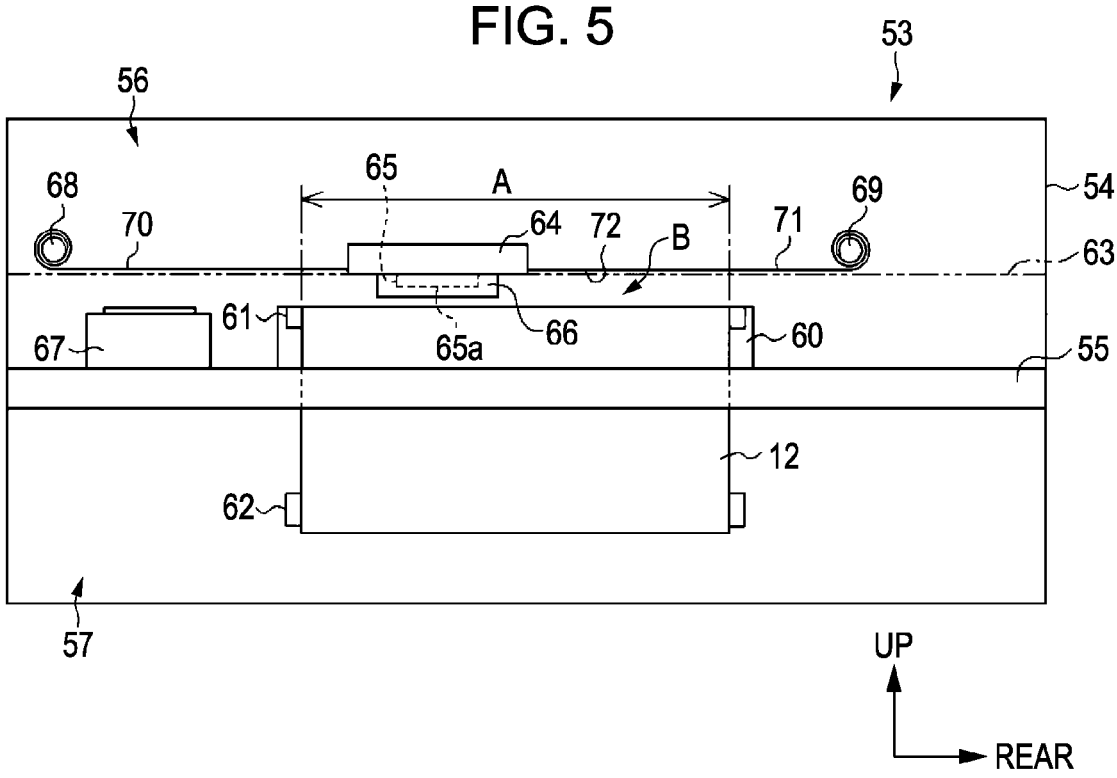
FIG. 5 is a schematic right side view illustrating an ink jet type printer according to a second embodiment of the invention.
Figure 6:
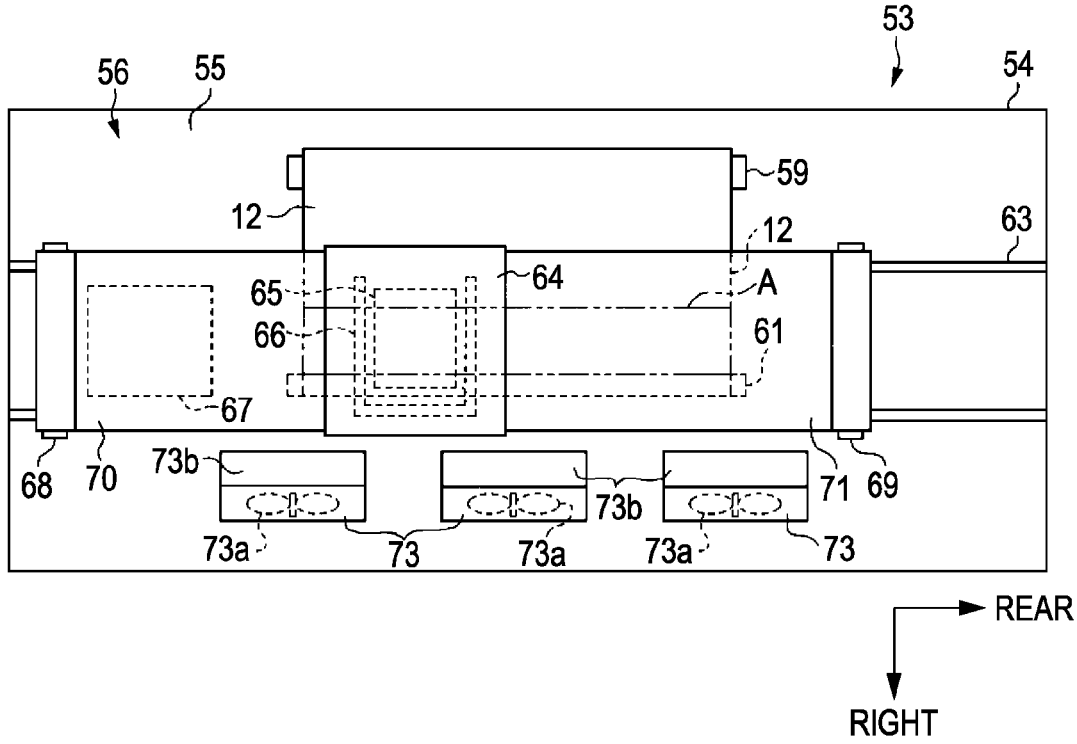
FIG. 6 is a schematic top plan view illustrating the ink jet type printer according to the second embodiment.

An ink jet type printer 53 includes a body casing 54 as a liquid ejecting apparatus as shown in FIG. 5. The body casing 54 is provided with a plate-like table 55 which is positioned near the central portion thereof in the up-down direction so as to partition the inside of the body casing 54 into upper and lower areas. The upper area of the table 55 in the body casing 54 is formed as a printing chamber 56 for printing on the continuous form paper 12. By contrast, the lower area of the table 55 in the body casing 54 is formed as a rewinding chamber 57 for rewinding the printed continuous form paper 12.

First, a transport mechanism for the continuous form paper 12 will be described.

The continuous form paper 12 is previously wound in a roll shape around a winding shaft 59 which extends in the front-rear direction and is rotatably provided on the left side (the inside in a direction perpendicular to the paper surface in FIG. 5) in the printing chamber 56. The area on the right side of the winding shaft 59 in the printing chamber 56 is provided with a platen 60 (refer to FIG. 5) as a supporting member having a rectangular planar shape supported on the table 55. The platen 60 is configured to be heated by a heater which is not shown. By transferring heat to the continuous form paper 12 on the heated platen 60, the platen 60 is configured to accelerate drying of ink adhered on the continuous form paper 12.

A turning roller 61 (refer to FIG. 5) which is opposed to the winding shaft 59 is provided on the right side of the platen 60 with the platen 60 interposed therebetween. A relay roller not shown is provided between the winding shaft 59 and the platen 60, and the top of the relay roller, the upper surface of the platen 60, and the top of the turning roller 61 are coplanar.

The turning roller 61 turns the transport direction of the continuous form paper 12 from the horizontal right direction into the vertical downward direction since the continuous form paper 12, which is drawn out from the winding shaft 59 and is transported horizontally in the right direction along the upper surface of the platen 60 through the relay roller, is suspended on the upper left portion of the turning roller 61. The continuous form paper 12 of which the transport direction is turned into the vertical downward direction by the turning roller 61 passes through an insertion opening, which is not shown, provided on the table 55, and is wound around the winding drive shaft 62 (refer to FIG. 5) which is rotatably provided below the turning roller 61 in the rewinding chamber 57.

Next, a printing mechanism for the continuous form paper 12 will be described.

Paired guide rails 63 (indicated by a chain double-dashed line in FIG. 5) extending in the front-rear direction are provided on either side of the left and right of the platen 60 in the printing chamber 56. The upper surfaces of the guide rails 63 are set higher than the upper surface of the platen 60. The upper surfaces of both guide rails 63 supports a carriage 64 as a rectangular planar movable body capable of reciprocating in the front-rear direction along the guide rails 63. The carriage 64 is configured to move in the front-rear direction on the guide rails 63 by driving a driving mechanism which is not shown.

The lower surface of the carriage 64 supports a printing head 65 as a liquid ejecting head. The lower surface of the carriage 64 supports a windshield member 66 having, in plan view, a U-shape which surrounds the right side and the front and rear sides of a nozzle formation surface 65*a* formed by the lower surface of the printing head 65 and opens toward the left side thereof. The lower surface of the windshield member 66 is positioned lower than the nozzle formation surface 65*a* of the printing head 65.

The nozzle formation surface 65*a* which is formed by the lower surface of the printing head 65 is provided with a plurality of nozzle openings (not shown). In the embodiment, the nozzle openings (not shown) are formed at a constant distance away from each other in the front-rear direction so as to form a plurality of nozzle arrays (not shown), which extends in the left-right direction, on the nozzle formation surface 65*a*.

Similarly to the first embodiment, ink is pressure-supplied to the printing head 65 from a plurality of ink cartridges (not shown) provided in the body casing 54, and is ejected from the nozzle openings (not shown).

However, in the embodiment, the printing is performed on the continuous form paper 12 by alternately repeating a printing operation and a paper feeding operation. The printing operation is performed by ejecting ink toward the printing surface 12*a* of the continuous form paper 12 while moving the carriage 64 in the front-rear direction, and the paper feeding operation is performed by transporting the continuous form paper 12 by a predetermined paper feeding amount in the right direction. Specifically, the present embodiment is different from the first embodiment in that the printing head 65 performs the printing operation while it moves in a direction orthogonal to the paper feeding direction.

A printing area A which is a liquid ejecting area is defined as an area in which the printing of the continuous form paper 12 is performed in the range from the front end to the rear end of the platen 60. A maintenance unit 67 for performing maintenance such as a cleaning of the printing head 65 is provided on the front side of the platen 60 on the table 55.

Next, a drying mechanism for the printed continuous form paper 12 will be described.

Paired rotary shafts 68 and 69 which constitute a displacement mechanism are provided on either side of the front and rear of the printing area A in the printing chamber 56. The rotary shafts 68 and 69 are configured to extend in the left-right direction and be rotatably supported by a supporting wall which is not shown. The rotary shaft 68 is provided on a front end portion corresponding to the front side of the maintenance unit 67 in the printing chamber 56. The rotary shaft 69 is provided near a rear end portion corresponding to the rear side of the platen 60.

A film member 70 is stretched above the guide rail 63. The film member 70 serves as a guide member of which the front end portion is wound around the rotary shaft 68 and of which the rear end portion is fixedly attached to the lower end portion of the front side surface of the carriage 64. The rear end portion of the film member 71 as a guide member pairing with the film member 70 is wound around the rotary shaft 69. The front end portion of the film member 71 is fixedly attached to the lower end portion of the rear side of the carriage 64.

Similarly to the first embodiment, the rotary shafts 68 and 69 rotate by moving the carriage 64 on the both guide rails 63 in the front-rear direction, and thus the film members 70 and 71 are wound around the rotary shafts 68 and 69 or those are displaced while being drawn out, thereby avoiding interference between the printing head 65 and the film members 70 and 71.

An air blowing device 73 (refer to FIG. 6, it is not shown in FIG. 5) is disposed on the right side of the platen 60 on the table 55. The inside of the air blowing device 73 is provided with a fan 73*a* which rotates to blow air by driving the driving mechanism not shown. Although not shown in the drawing, a heater is provided near the downstream side in an air-blowing direction of the fan 73*a* inside the air blowing device 73. The left side surface of the air blowing device 73 is provided with a blade plate 73*b* (refer to FIG. 6) for blowing air into a gap B (refer to FIG. 5) formed between the printing surface 12*a* of the continuous form paper 12 and the opposed surfaces 72 (refer to FIG. 5) of the film members 70 and 71.

Specifically, the air blowing device 73 is configured to blow hot air, which is guided by the blade plate 73*b* and flows leftward along the opposed surface 72 of the film members 70 and 71, toward the printing surface 12*a* of the continuous form paper 12, on which ink is adhered, on the platen 60, by rotating the fan 73*a* in a state where the heater is driven. In the embodiment, the suctioning device is not provided.

Next, operations of the ink jet type printer 53 configured as described above will be described.

First, when the printing is not performed, the carriage 64 is positioned on the maintenance unit 67, the most part of the film member 70 is wound around the rotary shaft 68, and the most part of the film member 71 is drawn out from the rotary shaft 69. Thus, the opposed surface 72 formed by the lower surface of the film member 71 covers over the upper surface of the platen 60 in the printing area A.

When the printing is performed, the platen 60 is heated, and the carriage 64 positioned on the maintenance unit 67 is moved in the rear direction in FIG. 5, and is placed on an initial position of the printing operation, on the front end side of the printing area A. In this case, the film member 70 wound around the rotary shaft 68 is drawn out, and the rear end portion of the film member 71 is wound around the rotary shaft 69.

Subsequently, when the continuous form paper 12 is transported to the platen 60, ink is ejected on the printing surface 12*a* from the printing head 65 while the carriage 64 moves in the front-rear direction, thereby performing the printing operation in the printing area A. Simultaneously, the air blowing device 73 blows hot air, thereby blowing air into the gap B. In this case, since the film members 70 and 71 are stretched in the air-blowing direction of the air blowing device 73, the blown air widely spreads over the entire printing surface 12*a* as laminar flow flowing in the horizontal left direction along the opposed surfaces 72 of the film members 70 and 71, thereby efficiently accelerating drying of the ink on the printing surface 12*a* of the continuous form paper 12.

According to the second embodiment mentioned above, advantages the same as the advantages 1 to 8 and 11 of the first embodiment can be obtained.

Third Embodiment

Next, a line-head ink jet type printer using a liquid ejecting apparatus according to a third embodiment of the invention will be described with reference to FIG. 7.

The ink jet type printer as a liquid ejecting apparatus of the present embodiment is substantially the same as that of the first embodiment in the transport mechanism for the continuous form paper 12, the printing mechanism for the continuous form paper 12, and the drying mechanism for the continuous form paper 12. However, there is a difference in that a printing head 75 is not moved to eject ink. Hereinafter, difference between the first embodiment and this embodiment will be described.

Figure 7:
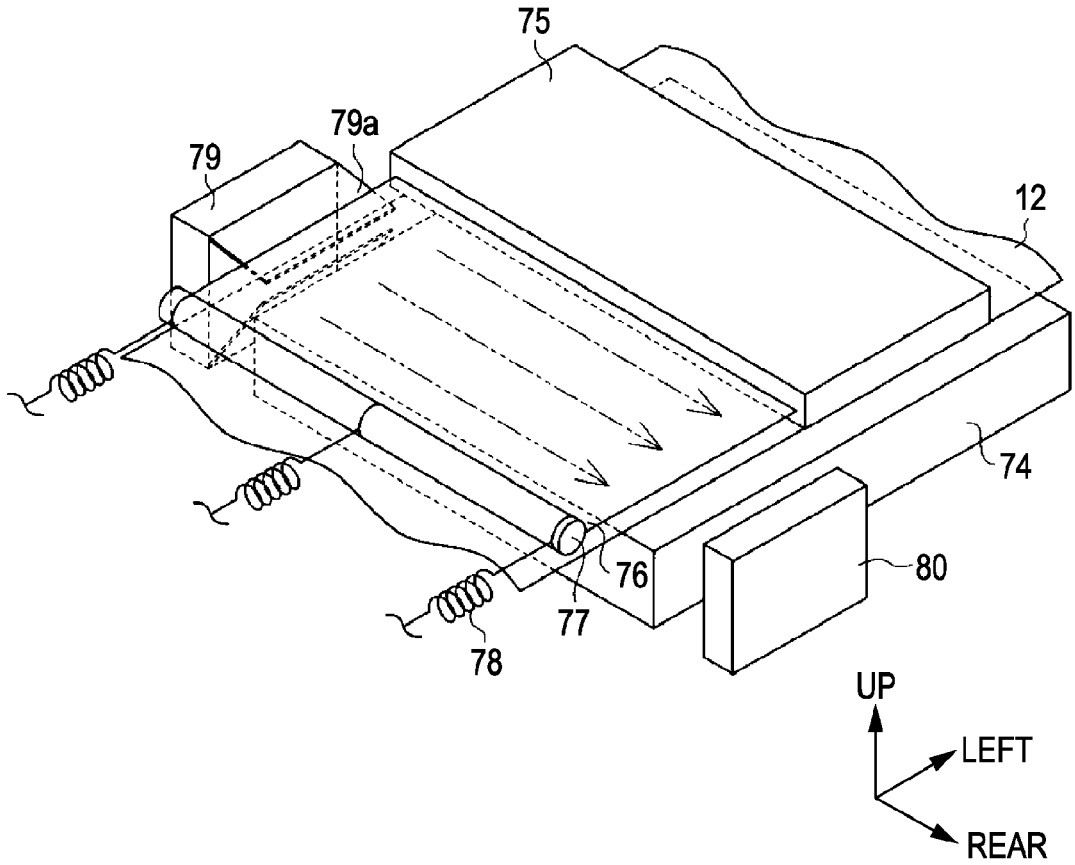
FIG. 7 is a schematic perspective view illustrating a drying mechanism of an ink jet type printer according to a third embodiment of the invention.

FIG. 7 is a partial perspective view illustrating the inside of the body casing 16 when viewed from obliquely above the right rear side thereof. In the drawing, the continuous form paper 12 is transported from the left to the right to be fed onto the platen 74. In addition, the printing is performed on the continuous form paper 12 by alternately repeating a printing operation and a paper feeding operation. The printing operation is performed by ejecting ink toward the printing surface 12*a* of the continuous form paper 12 from the printing head 75, and the paper feeding operation is performed by transporting the continuous form paper 12 by a predetermined paper feeding amount in the right direction.

The left end portion of the film member 76 as a guide member is fixedly attached to the right side surface of the printing head 75, and the right end portion of the film member 76 is fixedly attached to the rod-like member 77. One ends (the left end side in FIG. 7) of a plurality of spring members 78 as elastic members are stretched on the rod-like member 77 on the right end side of the film member 76.

The other ends (the right end side in FIG. 7) of the spring members 78 are stretched on a supporting plate which is not shown. Accordingly, one end of the film member 76 is stretched in a state where it is supported by the spring members 78, on the downstream side of the printing head 75 in the transport direction of the continuous form paper 12.

An air blowing device 79 having a heater and a fan built therein is disposed on the front side of the film member 76. The rear side surface of the air-blowing device 79 is provided with a blade plate 79*a* for blowing air into a gap B formed between the printing surface 12*a* of the continuous form paper 12 and the opposed surfaces (not shown) formed by the lower surface of the film member 76.

Meanwhile, a suctioning device 80 is disposed at a position opposed to the air blowing device 79 in the front-rear direction, on the rear side of the film member 76. The suctioning device 80 is configured to suction the air which is blown from the front side of the film member 76 toward the rear side thereof by the air blowing device 79.

Accordingly, the printing is performed by ejecting ink on the printing surface 12*a* from the printing head 75, subsequently the continuous form paper 12 is transported in the right direction such that the film member 76 covers over the printing surface 12*a* on which the printing had been performed, and the air blowing device 79 blows hot air while the suctioning device 80 suctions the air, thereby blowing air as laminar flow which flows along the printing surface 12*a*.

According to the third embodiment mentioned above, not only advantages the same as the advantages 1, 5, 7, and 9 to 13 of the first embodiment but also the following advantage can be obtained.

14. It is possible to absorb vibrations caused by air-blowing and displacement operations and the like through elastic deformation of the spring member 78 since the one end of the film member 76 is supported through the spring member 78.

Fourth Embodiment

Next, a lateral ink jet type printer using a liquid ejecting apparatus according to a fourth embodiment of the invention will be described with reference to FIG. 8.

The ink jet type printer as a liquid ejecting apparatus of the present embodiment is substantially the same as that of the first embodiment in the transport mechanism for the continuous form paper 12, the printing mechanism for the continuous form paper 12, and the drying mechanism for the continuous form paper 12. However, there is a difference in a displacement mechanism for avoiding interference between the printing head 42 and a film member 83 as a guide member. Hereinafter, difference between the first embodiment and this embodiment will be described.

Figure 8:
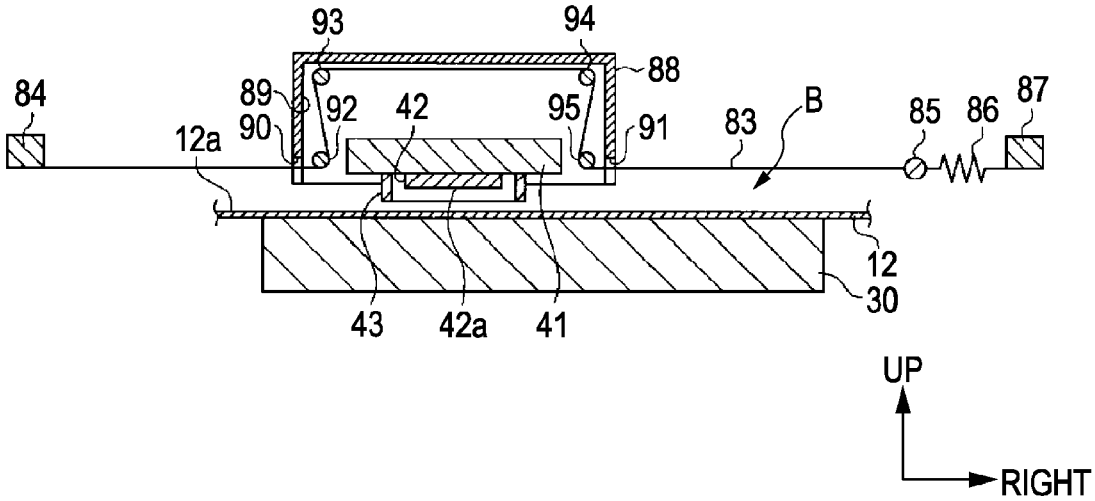
FIG. 8 is a schematic partial sectional view illustrating a displacement mechanism of an ink jet type printer according to a fourth embodiment of the invention.

The left end portion of the film member 83 of the embodiment is fixed on a supporting wall, which is not shown, by a fixing member 84, and the right end thereof is fixedly attached to a rod-like member 85 which extends in the front-rear direction (a direction perpendicular to the paper surface of FIG. 8), as shown in FIG. 8. One end (the left end side in FIG. 8) of a spring members 86 as an elastic member is stretched on the rod-like member 85 on the right end side of the film member 83. The other end (the right end side in FIG. 8) of the spring member 86 is fixed on the supporting wall, which is not shown, by the fixing member 87.

The printer according to the embodiment includes a housing member 88 having a bottomed box shape which opens downward, and is configured such that the carriage 41 and the printing head 42 are positioned in a concave portion 89 provided in the housing member 88. The housing member 88 is configured to move together with the carriage 41 in the left-right direction on both guide rails 40. The printing head 42 is configured to eject ink from the nozzle formation surface 42*a* toward the continuous form paper 12 through an opening of the concave portion 89 of the housing member 88.

The lower end portion of the left side wall of the housing member 88 is provided with a notch hole 90, and the lower end portion of the right end wall of the housing member 88 is provided with a notch hole 91. The inside of the concave portion 89 of the housing member 88 houses rotary rollers 92, 93, 94, and 95 as rotary members constituting a displacement mechanism. The rotary rollers 92, 93, 94, and 95 extends in the front-rear direction (the direction perpendicular to the paper surface in FIG. 8), and both ends of those are rotatably supported on the housing member 88.

Specifically, the rotary rollers 92 and 95 are disposed at a height position where the film member 83 is stretched, relative to the carriage 41. In addition, the rotary roller 93 is disposed above the rotary roller 92, and the rotary roller 94 is disposed above the rotary roller 95. In other words, the rotary members 93 and 94 are disposed at a position which is farther than the height position of the rotary rollers 92 and 95 from the platen 30.

The film member 83 is configured to be displaced by winding it around the rotary rollers 92, 93, 94, and 95 in the concave portion 89 of the housing member 88 above the platen 30. That is, the film member 83, which is housed in the concave portion 89 through the notch holes 90 and 91, is stretched in the upward direction from the horizontal right direction since the left end portion of the film member 83 in the concave portion 89 is suspended on the lower left portion of the rotary roller 92.

Subsequently, the film member 83 is stretched in the horizontal right direction from the upward direction since it is suspended on the lower portion of the rotary roller 93, and is stretched in the downward direction from the horizontal right direction since it is suspended on the upper left portion of the rotary roller 94. Moreover, the film member 83, which is stretched in the horizontal right direction from the downward direction by being suspended on the upper left portion of the rotary roller 95, is configured to get out of the inside of the concave portion 89 of the housing member 88 through the notch hole 91.

It is avoided that the film member 83 interferes with the printing head 42 in the concave portion 89 of the housing member 88 while the stretching state of the film member 83 is kept since the rotary rollers 92, 93, 94, and 95 rotate as the carriage 41 moves in the left-right direction on both guide rail 40. That is, the film member 83 is configured to be displaced in a direction of avoiding interference with the printing head 42 by rotational force of the rotary rollers 92, 93, 94, and 95.

According to the fourth embodiment mentioned above, not only advantages the same as the advantages 1 to 4 and 7 to 14 of the above-mentioned embodiments but also the following advantage can be obtained.

15. The film member 83 is suspended on the rotary rollers 92, 93, 94, and 95 so as to avoid interference with the printing head 42 while the rotary members 93 and 94 are supported at a position which is farther than the height position of the rotary rollers 92 and 95 from the platen 30. As a result, it is possible to avoid interference between the film member 83 and the printing head 42 since the extending direction of the film member 83 is changed by the rotary rollers 92, 93, 94, and 95 so as to partially change the height of the film member stretched in the concave portion 89.

The above-mentioned embodiments may be modified as the following forms.

In the embodiments, not the film members 47, 48, 70, 71, 76, and 83 but, for example, a planar member may be used as the guide member.

In the embodiments, the other end portions of the film members 47, 48, 70, and 71 of which the one end portions are wound around the respective rotary shafts 45, 46, 68, and 69 may be fixedly attached to the printing heads 42 and 65.

In the embodiments, the film members 47, 48, 70, 71, 76, and 83 as guide members are not directly fixed and attached to the printing heads 42, 65, and 75 or the carriages 41 and 64, but a fixing member and the like may be interposed therebetween.

In the embodiments, it may be possible to adopt a configuration in which a printing head or a carriage moves while pushing a guide member having a slit.

In the embodiments, the air blowing device may blow a dry air in which water vapor amount is small. In this case, it is possible to accelerate evaporation of solvent.

In the embodiments, the elastic member is not limited to the spring members 78 and 86, a band-like rubber may be used.

In the embodiments, when a target has a curved surface, ink may be ejected on the curved surface. In this case, it is possible to blow air along the ink-adhered surface formed by the curved surface of the target by employing a guide member having an opposed surface formed by a curved surface following the curved surface of the target.

In the embodiments, an elongated plastic film or the like may be used as a target, instead of the continuous form paper 12.

In the embodiments, ink jet type printers as liquid ejecting apparatuses have been described, but the invention is not limited to those, it may be possible to embody a liquid ejecting apparatus for ejecting not ink but different liquid (which includes a liquid material formed by dispersing or mixing functional particulates in or with liquid and a fluid material such as gel). For example, it may be possible to use a liquid ejecting apparatus for ejecting liquid (a liquid material) which includes, in a dispersed or dissolved form, materials such as an electrode material and a color material (a pixel material) used in fabrication of a liquid crystal display, an EL (electro luminescence) display, and a surface emission display, and the like. In addition, it may be possible to use a liquid ejecting apparatus for ejecting a bio-organic material used in biochip fabrication and a liquid ejecting apparatus, which is used as a precision pipette, for ejecting liquid as a specimen. Moreover, it may be possible to use a liquid ejecting apparatus for ejecting lubricating oil to precision instruments such as a clock and a camera by using a pin point method, a liquid ejecting apparatus for ejecting transparent resin liquid such as ultraviolet curable resin on a substrate in order to form a micro hemispherical lens (optical lens) used in an optical communication element, a liquid ejecting apparatus for ejecting etching liquid such as acid or alkali in order to perform an etching on a substrate and the like, and a liquid ejecting apparatus for ejecting liquid (fluid material) such as gel (for example, physical gel). The invention may be applied to any one of the liquid ejecting apparatuses.

What is claimed is:

1. A liquid ejecting apparatus comprising:

a supporting member that supports a target;

a liquid ejecting head that ejects liquid to a liquid ejecting surface of the target supported by the supporting member;

an air blowing device that blows air to the liquid ejecting surface of the target supported by the supporting member; and a guide member that has an opposed surface which is closely opposed to the liquid ejecting surface of the target supported by the supporting member and forms a gap for passing the air, which is blown by the air blowing device as laminar flow along the liquid ejecting surface, between the opposed surface and the liquid ejecting surface, wherein the guide member is formed by a film member stretched to cover the liquid ejecting surface of the target.

2. The liquid ejecting apparatus according to claim 1, wherein the liquid ejecting head is configured to be movable along the liquid ejecting surface of the target, relative to the supporting member, and wherein the liquid ejecting apparatus further comprises a displacement mechanism that displaces the film member so as to avoid interference with the liquid ejecting head when the liquid ejecting head moves relative to the supporting member.

3. The liquid ejecting apparatus according to claim 2, wherein the displacement mechanism has rotary members which rotate in accordance with movement of the liquid ejecting head relative to the supporting member, and the film member is displaced in a direction of avoiding interference with the liquid ejecting head by rotational force of the rotary members.

4. The liquid ejecting apparatus according to claim 3, wherein one end of the film member is fixedly attached to the liquid ejecting head or a movable body which is movable with the liquid ejecting head mounted thereon, the other end thereof is wound around the rotary member, and the rotary member is rotationally urged in a direction of winding the film member.

5. The liquid ejecting apparatus according to claim 3, wherein at least the one end of the film member is supported by an elastic member, and the rotary members are supported at height positions where the film member is stretched, and at positions which are farther than the height position from the supporting member, respectively, relative to the movable body which is movable with the liquid ejecting head mounted thereon, and the film member is suspended on the rotary members so as to avoid interference with the liquid ejecting head.

6. The liquid ejecting apparatus according to claim 1, wherein at least a part of the guide member covering the liquid ejecting surface of the target is transparent.

7. The liquid ejecting apparatus according to claim 1, further comprising a windshield member that shields a nozzle formation surface of the liquid ejecting head from the air blown by the air blowing device.

8. The liquid ejecting apparatus according to claim 1, further comprising a suctioning device that suctions the air passed through a gap between the opposed surface of the guide member and the liquid ejecting surface of the target, the suctioning device provided on a downstream side in an air-blowing direction of the air blowing device.

9. The liquid ejecting apparatus according to claim 1, wherein the air blowing device is configured to blow air in a direction parallel to an extending direction of a nozzle array formed on a nozzle formation surface of the liquid ejecting head.

* * * * *